US007114496B1

(12) United States Patent
Resnick et al.

(10) Patent No.: US 7,114,496 B1
(45) Date of Patent: Oct. 3, 2006

(54) FILTER CARTRIDGE WITH INTEGRATED INHALATION AND EXHALATION VALVES

(75) Inventors: Todd A Resnick, Stuart, FL (US); Richard L Stein, Lake Forest, CA (US)

(73) Assignee: TMR-D, LLC, Stuart, FL (US)

( * ) Notice: Subject to any disclaimer, the term of this patent is extended or adjusted under 35 U.S.C. 154(b) by 0 days.

(21) Appl. No.: 10/906,704

(22) Filed: Mar. 2, 2005

(51) Int. Cl.
*A62B 7/10* (2006.01)
*A62B 18/08* (2006.01)

(52) U.S. Cl. ..... 128/201.25; 128/205.29; 128/206.17

(58) Field of Classification Search ..... 128/205.27, 128/205.28, 205.29, 206.12, 206.15, 206.16, 128/206.17, 206.18, 206.21, 207.12, 201.25, 128/205.25; 55/DIG. 32, DIG. 33
See application file for complete search history.

(56) References Cited

U.S. PATENT DOCUMENTS 476,486 A * 6/1892 Pozdena ..... 128/206.15
2,610,624 A * 9/1952 Haller et al. ..... 128/205.29
3,731,678 A * 5/1973 Pyzel ..... 128/202.26
4,688,567 A * 8/1987 Kikuchi et al. ..... 128/206.15
4,932,399 A * 6/1990 Cappa et al. ..... 128/202.27
5,222,479 A * 6/1993 Brauer et al. ..... 128/202.26
5,353,789 A * 10/1994 Schlobohm ..... 128/206.24
6,736,137 B1 * 5/2004 Resnick et al. ..... 128/201.25
6,860,267 B1 * 3/2005 Capon et al. ..... 128/206.15
6,966,318 B1 * 11/2005 Tsuug et al. ..... 128/206.11

* cited by examiner

*Primary Examiner*—Teena Mitchell
(74) *Attorney, Agent, or Firm*—Anton J. Hopen; Smith & Hopen, P.A.

(57) ABSTRACT

The present invention is a filter cartridge with integrated inhalation and exhalation valves. The exhalation valve integrated into the filter cartridge prevents unfiltered air from being inhaled. The inhalation valve(s), also integrated into the filter cartridge, effectively reduces the dead space inside the filter cartridge and thereby limits re-breathing of carbon dioxide.

16 Claims, 8 Drawing Sheets

FILTER CARTRIDGE WITH INTEGRATED INHALATION AND EXHALATION VALVES

FIELD OF INVENTION

This invention relates to a filter cartridge with integrated inhalation and exhalation valves that minimize re-breathed carbon dioxide, reduce package size and maximize reliability.

SUMMARY OF INVENTION

The present invention is a filter cartridge that reduces re-breathed carbon dioxide, minimizes package size and maximizes reliability. Accumulation of carbon dioxide in the filter cartridge is minimized by directing exhaled air out an exhalation valve and minimizing the effective dead space inside the filter cartridge. The package size is reduced by locating all inhalation and exhalation valves inside the filter cartridge thus eliminating the need to mount corresponding valves directly to a full face piece, half-mask, hood or any other type of breathing interface. Overall reliability is improved by fully enclosing all inhalation and exhalation valves, thereby protecting all valves from dust, dirt, impact or tampering.

The filter cartridge includes filtration media through which inhaled air is passed, a housing encasing the filtration media, a respiration port in the housing for passing filtered air and exhaled air to and from a breathing interface, an exhalation port in the housing for discharging exhaled air, an inhalation plate disposed between the filtration media and the respiration port, an inhalation check valve set in the inhalation plate, the inhalation check valve having an open state during inhalation and a closed state during exhalation, an exhalation check valve set in the exhalation port, the exhalation check valve having a closed state during inhalation and an open state during exhalation, whereby inhaled air is passed through and filtered by the filtration media, is then passed through the inhalation check valve in its open state, is blocked from the exhalation port by the exhalation valve in its closed state, and passed to the respiration port.

It should be noted that the filter cartridge envelopes the inhalation check valves, the filtration media and the respiratory pathway through which air passes within the filter cartridge. This feature clearly advances the art over filters that have exposed check valves subject to damage, tampering or degradation. An embodiment of the invention fully encases the check valves and filtration media with only the respiration port, exhalation port and the particulate filter housing externally exposed. By internalizing many of the mechanical components of protective respiratory devices into a single filter cartridge, reliability is increased while costs are reduced. In addition, by aggregating multiple mechanical functions common to respiratory devices into a single housing more efficient and rigorous testing may be done on future respiratory protective device designs.

The inventive design described and enabled herein provides improved usability for the wearer as carbon dioxide, heat and moisture are reduced. Improved usability and comfort are often directly related to the maximum amount of time a protective respiratory device is donned or engaged. Thus, by increasing the maximum amount of time the protective device is used, the overall safety of the user is enhanced.

Exhaled air is passed from the respiration port, blocked by the inhalation valve in its closed state, passed through the exhalation check valve in its open state and is then discharged out the exhalation port. The filter cartridge may have a plurality of inhalation check valves and a plurality of exhalation check valves. The check valves may be annular diaphragms or other construction as known in the art of check valve design.

A mount for fluidly coupling the filter cartridge to the breathing interface may be of various means including screw-threaded, bayonet, interference fit or the like. The filter may couple to any breathing interface including, but not limited to the following: hood, helmet, full face piece, half-mask, quarter-mask, mouthpiece and protective suit with integrated hood.

An advantage of the invention is that the inhalation valves prevent moisture, heat and carbon dioxide present in exhaled air from saturating and/or accumulating in the filtration media. Thus, the invention reduces the amount of moisture, heat and carbon dioxide that would otherwise be re-breathed absent the present design.

Another advantage of the invention is that the inhalation and exhalation check valves are protected from dust, direct impact and/or tampering.

Another advantage of the invention is that the overall size of the apparatus is reduced due to the integration of inhalation and exhalation valves inside the filter cartridge thus eliminating the need to mount corresponding valves directly to a full face piece, half-mask, hood or any other type of breathing interface.

Still another advantage of the present invention is that the collection of critical parts, namely, the exhalation valve, inhalation valve and filtration media may be collectively replaced with a single unit filter cartridge.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
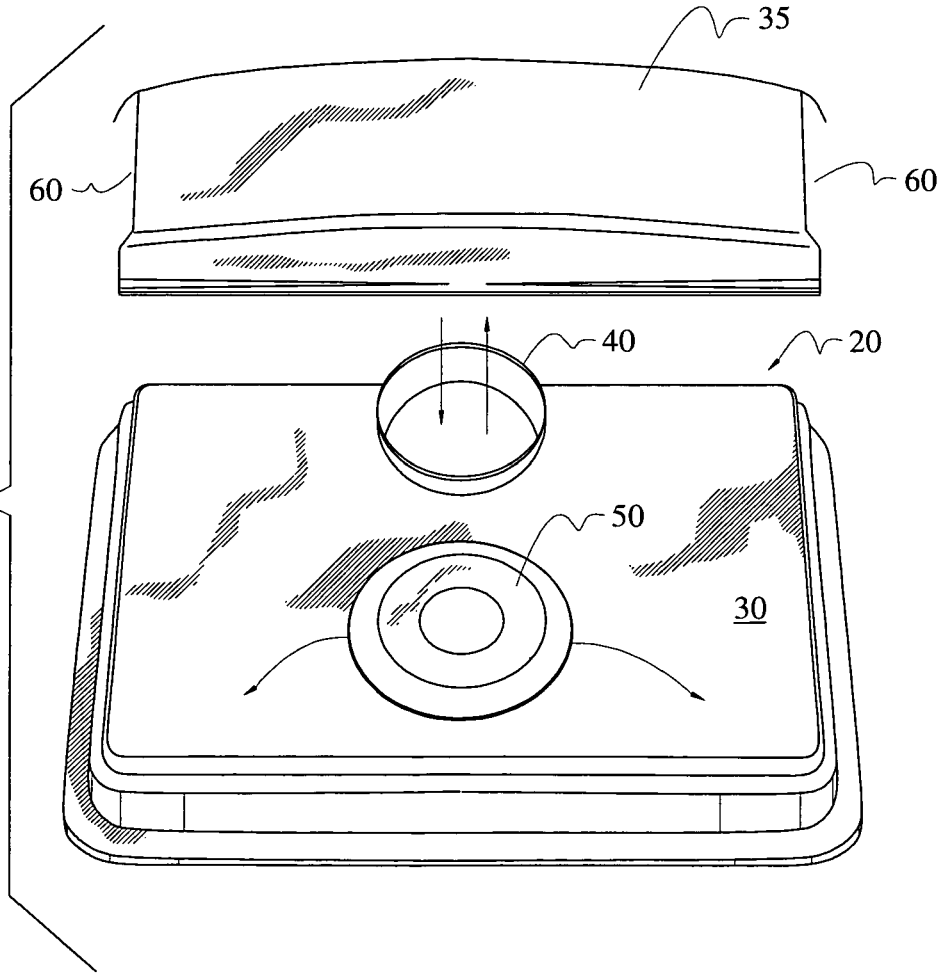
FIG. 1 is a perspective view of the rear side of the filter housing with the exhalation valve cover removed.
Figure 2:
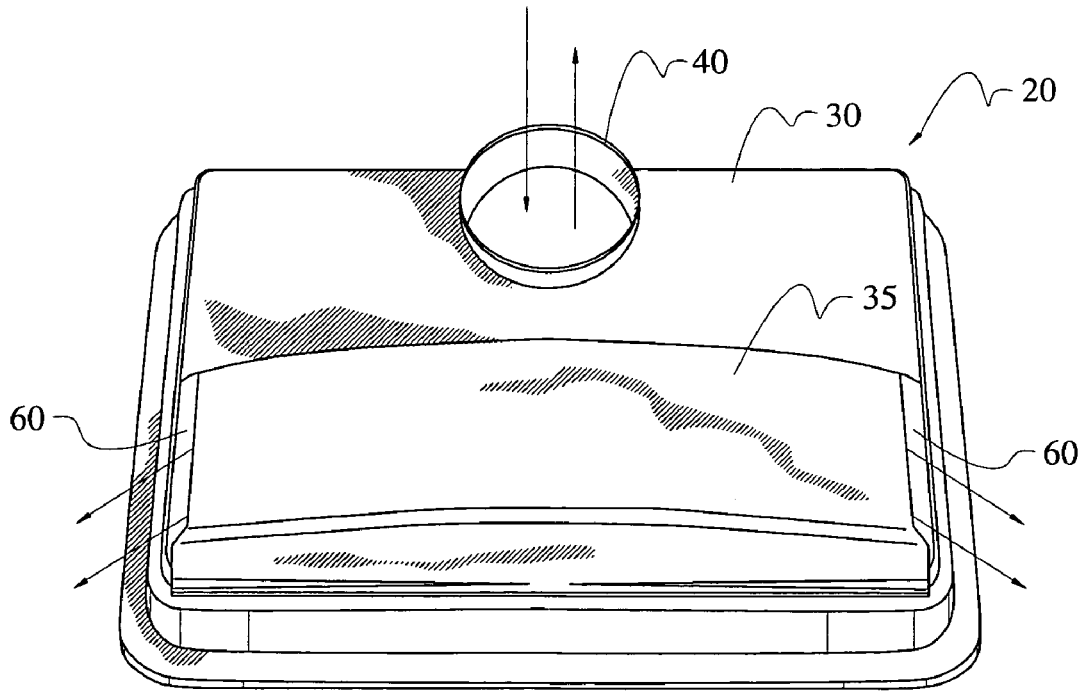
FIG. 2 is a perspective view of the rear side of the filter housing with exhalation valve cover attached.
Figure 6:
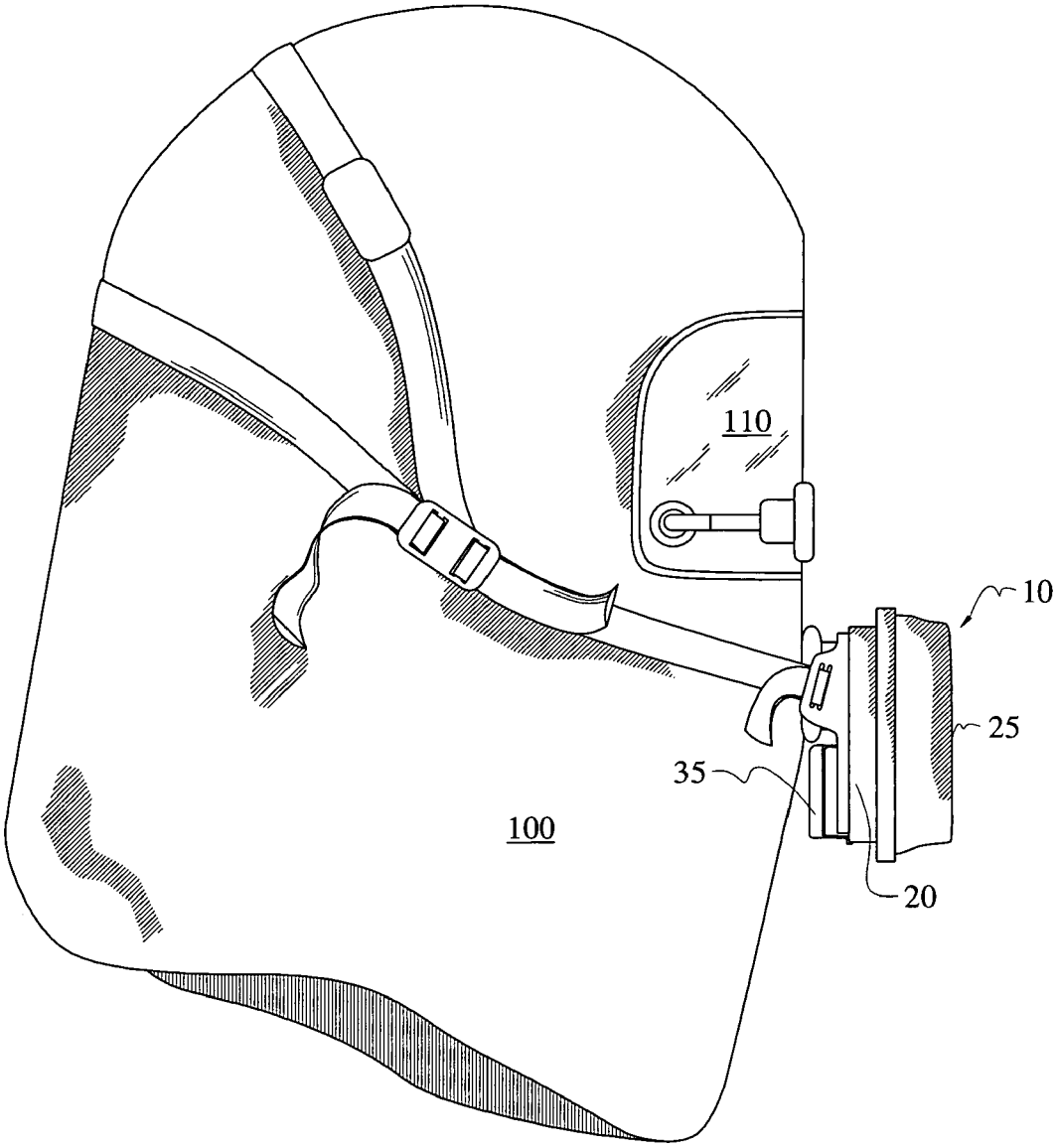
FIG. 6 is a side view of the filter housing secured to a respiratory protective hood.
Figure 7:
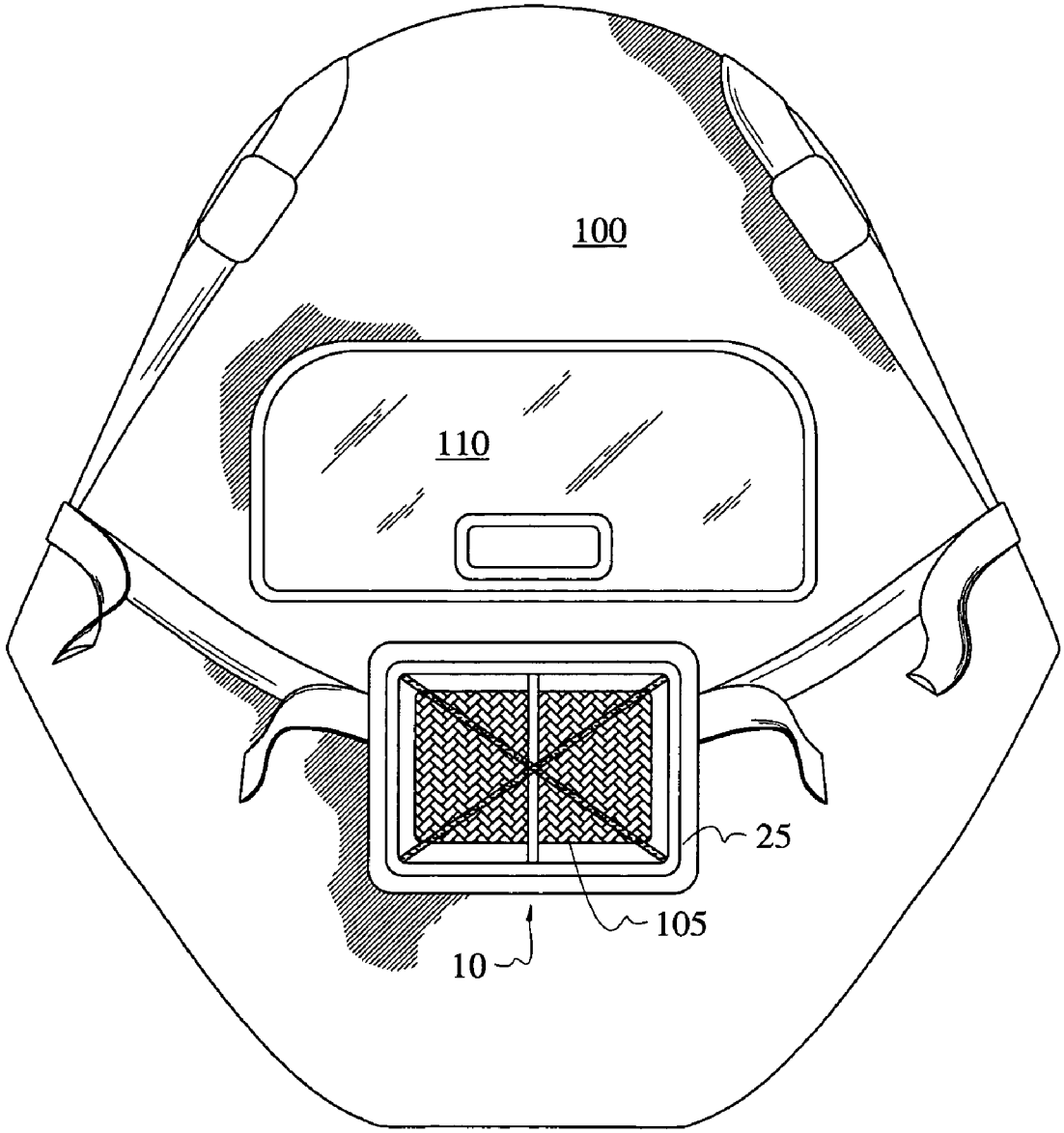
FIG. 7 is a front view of the filter housing secured to a respiratory protective hood.
Figure 8:
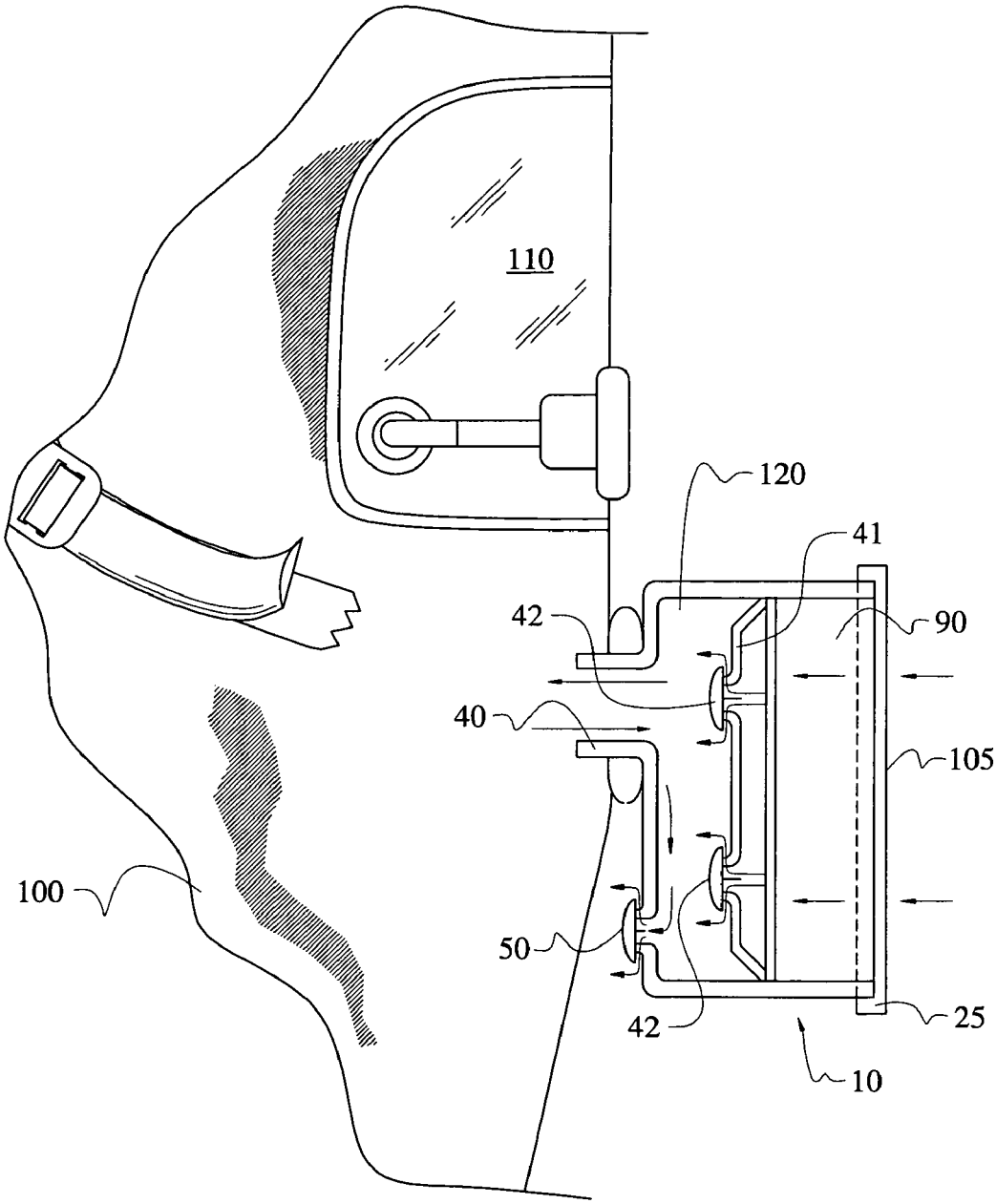
FIG. 8 is a side sectional view of the filter housing showing an inhalation air pathway and an exhalation air pathway according to the invention.

Turning to FIG. 1, rear side 30 of filter housing 20 has single respiration port 40 and exhalation check valve 50. Exhalation check valve 50 is a resilient elastomeric disc secured to filter housing 20 at the center axis of the disc. Exhalation ports 60 are formed by the attachment of exhalation valve cover 35. Single respiration port 40 provides a pathway from filter housing 20 through barrier 100 (FIGS. 6 through 8). In FIG. 2, the placement of exhalation valve cover 35 is shown. It can therefore be seen how exhaled air, the flow of which is indicated by arrows, is discharged through exhalation ports 60.

Figure 3:
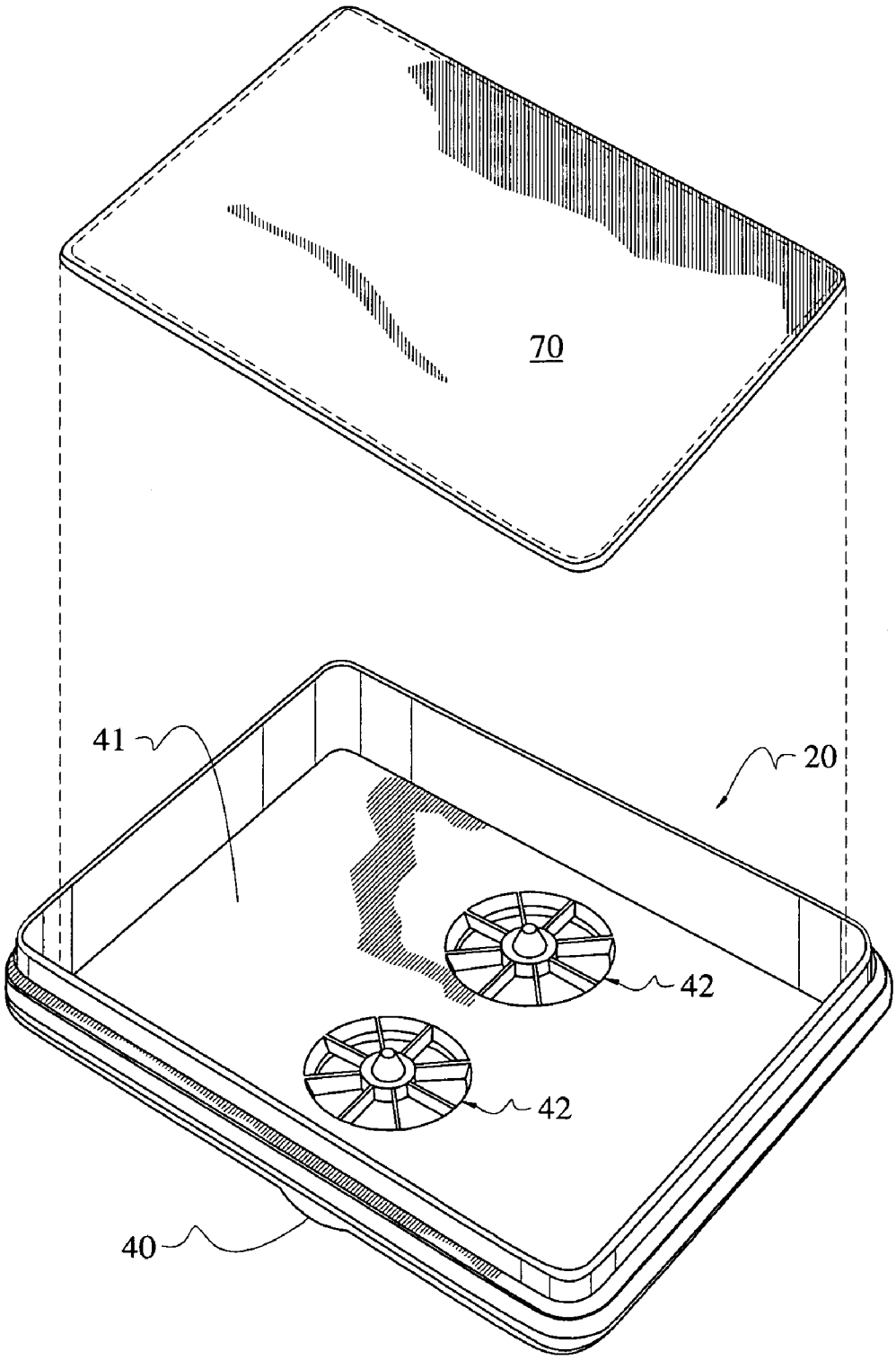
FIG. 3 is a partially exploded, perspective view of the carbon retention pad which is shown over the interior of the filter housing.
Figure 4:
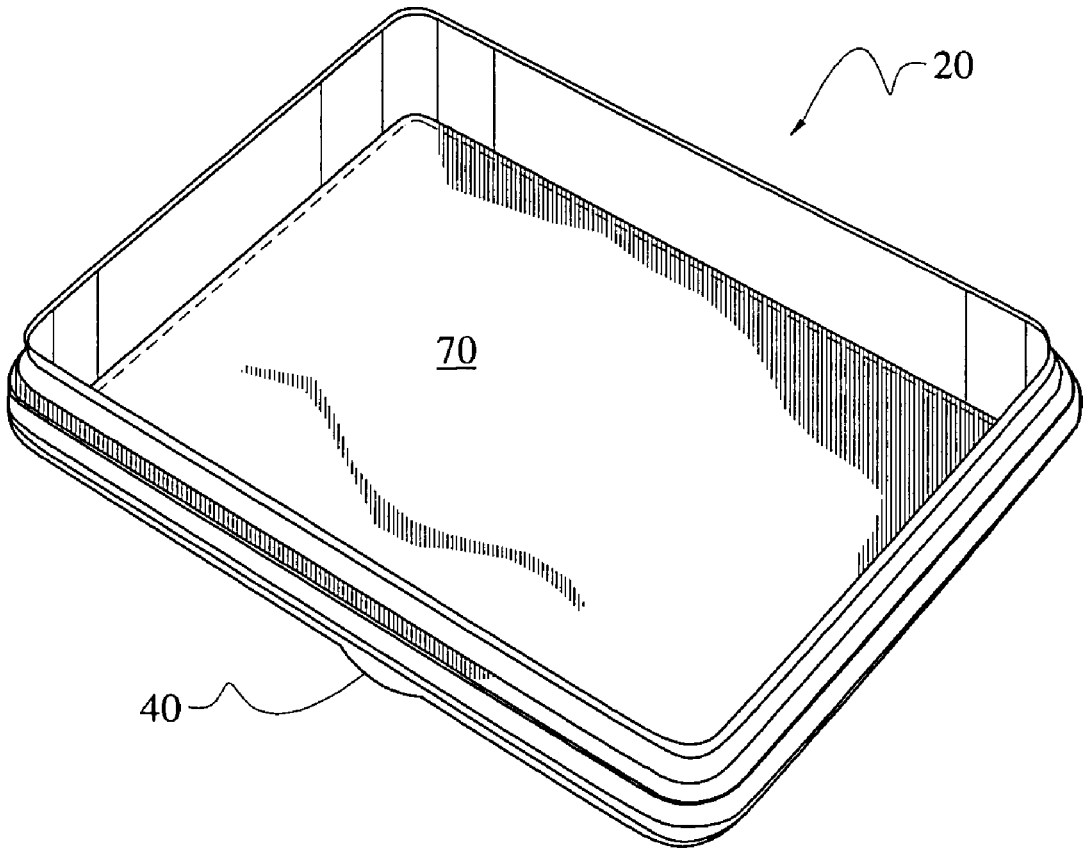
FIG. 4 is a perspective view of the interior of the filter housing with the carbon retention pad installed.

In FIG. 3, the interior chamber of filter housing 20 is viewable. A carbon retention pad 70 is laid within filter housing 20 over inhalation plate 41 which comprises a pair of inhalation check valves 42. It should be noted that while two inhalation check valves are illustrated, any number of inhalation check valves may be used balancing inhalation breathing resistance, structural integrity, operational simplicity and manufacturing costs. Dual inhalation check valves 42 prohibit exhaled air from entering filtration media 80 (FIG. 5), thereby reducing heat, moisture, and carbon dioxide accumulation. In FIG. 4 inhalation plate 41 is hidden. In this manner, the relation of carbon retention pad 70 to the inner volume of filter housing 20 can be seen. The interface between carbon retention pad 70 and inhalation plate 41 is planar.

Figure 5:
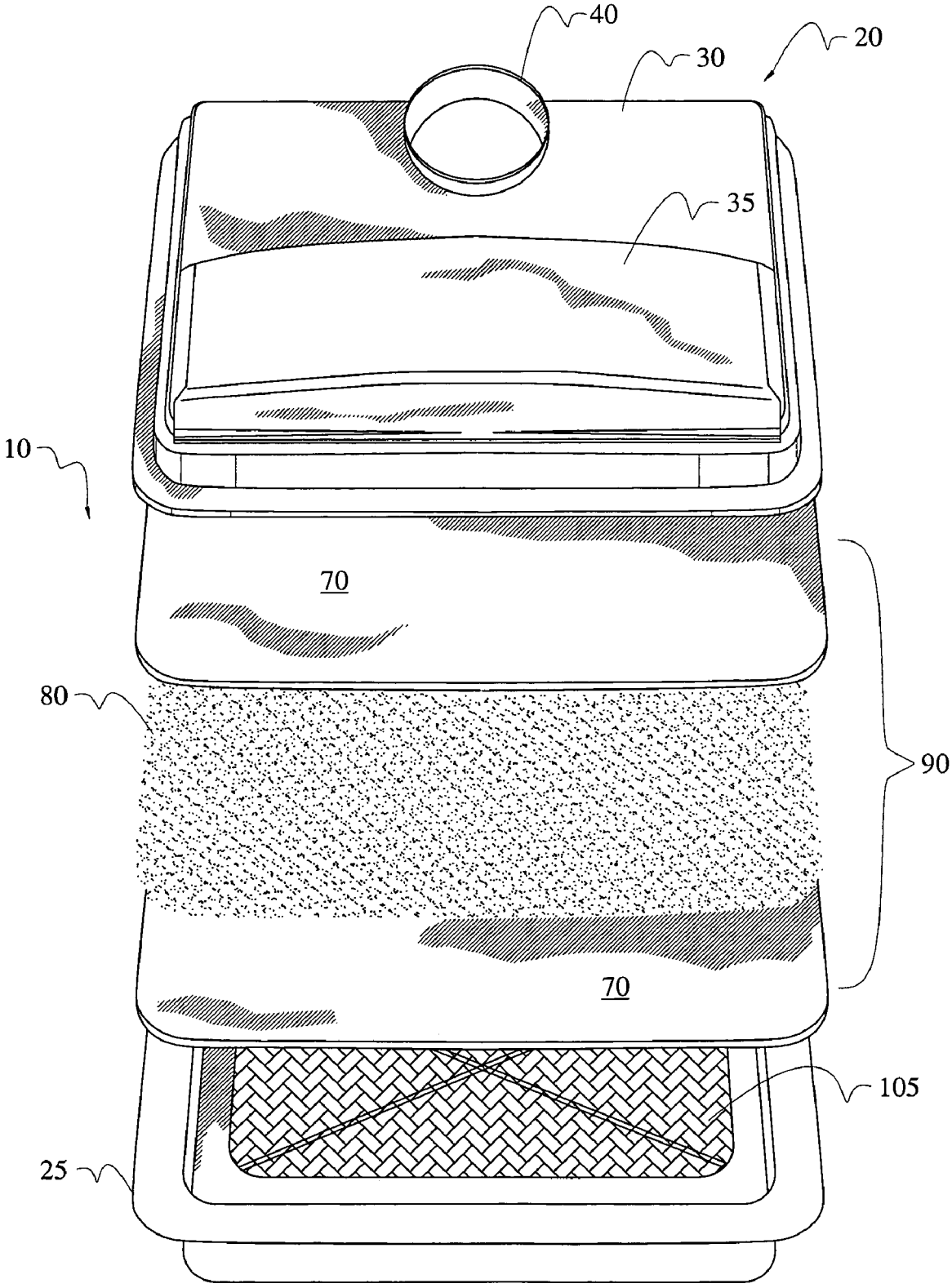
FIG. 5 is a partially exploded, perspective view of the particulate filter housing in overlying relation to the filtration media, which is in turn below the interior chamber of the filter housing.

FIG. 5 is an exploded view of the inventive filter cartridge, indicated as a whole by numerical identifier 10. Here it can be seen how the carbon bed 80 is sandwiched between two carbon retention pads 70 to form the retained carbon bed 90. Retained carbon bed 90 is enclosed between filter housing 20 and particulate filter housing 25. The particulate filter housing 25 provides fluid communication between ambient air and the inner volume of the filter cartridge 10. The invention should not be construed to be limited to any particular type of breathing filter or breathing filter application. Exhalation of moisture, carbon dioxide and heat occurs regardless of filter medium type and the re-breathing of exhaled air, particularly carbon dioxide is undesirable.

FIGS. 6 and 7 show filter cartridge 10 fluidly connecting through barrier 100. The relative position of filter cartridge 10 is shown in relation to barrier 100. It can be seen that the internalization of exhalation and inhalation valves within the cartridge itself greatly simplifies the complexity of the hood. The cartridge as provided in this invention may be deployed on a wide variety of protective devices. Thus, a single design produced in high volume provides opportunities to increase overall quality, standardized testing and reduced replacement inventory requirements compared to proprietary designs for various models of protective hoods and masks. Another advantage of the internalization of the valves within the cartridge is that the protective hood has less potential points of failure. The more openings and seals made in the hood, the more likely one of those seals may fail. By using the present invention, protective respiratory apparatus may be manufactured, assembled and deployed with a higher reliability factor while reducing overall cost. Visor 110 is illustrated to identify the ocular area of the wearer.

FIG. 8 illustrates the inhalation pathway whereby air passes through particulate filter housing 25, retained carbon bed 90 and inhalation check valve 42, in an open state, then through respiration port 40. Exhalation check valve 50, subject to a vacuum during inhalation, is drawn into a closed state. During exhalation, inhalation check valve 42 closes to prevent moisture, heat and carbon dioxide from entering retained carbon bed 90. The exhalation check valve 50 opens allowing air to discharge first through plenum 120 and then through the exhalation ports 60 (FIGS. 1–2). The volume of plenum 120 is limited in order to minimize total dead space inside filter cartridge 10. Accordingly, as shown in FIG. 8, inhalation check valve 42 is interposed between retained carbon bed 90 and exhalation check valve 50. Applicant's novel design disposes exhalation check valve 50 proximate to respiration port 40 relative to carbon bed 90.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A filter cartridge enveloping an inhalation check valve, an exhalation check valve, a filtration media and a respiration pathway, the inhalation check valve disposed between the filtration media and the respiration pathway, the inhalation valve also interposed between the exhalation check valve and the filtration media, the inhalation check valve permitting inhalation of filtered air but blocking exhaled air from reaching the filtration media.

2. A filter cartridge enveloping an inhalation check valve, an exhalation check valve, a filtration media and a respiration pathway, the inhalation check valve disposed between the filtration media and the respiration pathway, the inhalation valve also interposed between the exhalation check valve and the filtration media, the inhalation check valve permitting inhalation of filtered air but blocking exhaled air from reaching filtration media and the exhalation valve integral to the filter cartridge, the exhalation valve blocking non-filtered air from inhalation but discharging exhaled air.

3. A filter cartridge enveloping an inhalation plate, an exhalation check valve, a filtration media, and a respiration pathway, the inhalation plate disposed between the filtration media and the respiration pathway, the inhalation valve also interposed between the exhalation check valve and the filtration media, the inhalation plate having at least one inhalation check valve permitting inhalation of filtered air but blocking exhaled air from reaching filtration media.

4. A filter cartridge enveloping an inhalation plate, an exhalation check valve, a filtration media and a respiration pathway, the inhalation plate disposed between the filtration media and the respiration pathway, the inhalation valve also interposed between the exhalation check valve and the filtration media, the inhalation plate having at least one inhalation check valve permitting inhalation of filtered air but blocking exhaled air from reaching filtration media and an exhalation valve integral to the filter cartridge, the exhalation valve blocking non-filtered air from inhalation but discharging exhaled air.

5. A filter cartridge comprising: filtration media through which inhaled air is passed; a housing encasing the filtration media; a filter cartridge inlet in the housing for drawing unfiltered air into the housing and through the filtration media; a respiration port in the housing for passing filtered air and exhaled air to and from a breathing interface; an exhalation port in the housing for exhaled air; an inhalation plate disposed between the filtration media and the respiration port; the inhalation valve also interposed between the exhalation check valve and the filtration media; an inhalation check valve set in the inhalation plate, the inhalation check valve having an open state during inhalation and a closed state during exhalation; an exhalation check valve set in the exhalation port, the exhalation check valve having a closed state during inhalation and an open state during exhalation; whereby inhaled air is passed through the filter cartridge inlet, is filtered by the filtration media, is then passed through the inhalation check valve in its open state, is blocked from the exhalation port by the exhalation valve in its closed state, and passed to the respiration port; whereby exhaled air is passed from the respiration port, is blocked by the inhalation valve in its closed state, through the exhalation check valve in its open state and then discharged out the exhalation port.

6. The filter cartridge of claim 5 further comprising a breathing interface fluidly coupled to the filter, the breathing interface selected from the group consisting of hoods, helmets, full face pieces, half-masks, quarter-masks, mouthpieces and protective suits with integrated hoods.

7. A filter cartridge enveloping both an inhalation check valve and an exhalation check valve, the inhalation check valve fluidly coupling a particulate filter housing to a respiration port and the exhalation check valve fluidly coupling the respiration port to the exhalation port, the inhalation valve interposed between the exhalation check valve and the filtration media whereby the inhalation check valve permits inhalation of filtered air but blocks exhaled air from reaching a filtration media and the exhalation check valve permits exhalation to the exhalation port but does not permit inhaled air from reaching the exhalation port.

8. The filter cartridge of claim 7 wherein the exhalation port is formed by an exhalation valve cover over the exhalation check valve.

9. A filter cartridge enveloping an inhalation check valve, an exhalation check valve, a filtration media and a respiration pathway, the inhalation check valve disposed between the filtration media and the respiration pathway, the exhalation check valve disposed proximate to the respiration pathway relative to the filtration media, the inhalation check valve permitting inhalation of filtered air but blocking exhaled air from reaching the filtration media.

10. A filter cartridge enveloping an ae inhalation check valve, an exhalation check valve, a filtration media and a respiration pathway, the inhalation check valve disposed between the filtration media and the respiration pathway, the exhalation check valve disposed proximate to the respiration pathway relative to the filtration media, the inhalation check valve permitting inhalation of filtered air but blocking exhaled air from reaching filtration media and the exhalation valve integral to the filter cartridge, the exhalation valve blocking non-filtered air from inhalation but discharging exhaled air.

11. A filter cartridge enveloping an inhalation plate, an exhalation check valve, a filtration media, and a respiration pathway, the inhalation plate disposed between the filtration media and the respiration pathway, the exhalation check valve disposed proximate to the respiration pathway relative to the filtration media, the inhalation plate having at least one inhalation check valve permitting inhalation of filtered air but blocking exhaled air from reaching filtration media.

12. A filter cartridge enveloping an inhalation plate, an exhalation check valve, a filtration media and a respiration pathway, the inhalation plate disposed between the filtration media and the respiration pathway, the exhalation check valve disposed proximate to the respiration pathway relative to the filtration media, the inhalation plate having at least one inhalation check valve permitting inhalation of filtered air but blocking exhaled air from reaching filtration media and an exhalation valve integral to the filter cartridge, the exhalation valve blocking non-filtered air from inhalation but discharging exhaled air.

13. A filter cartridge comprising: filtration media through which inhaled air is passed; a housing encasing the filtration media; a filter cartridge inlet in the housing for drawing unfiltered air into the housing and through the filtration media; a respiration port in the housing for passing filtered air and exhaled air to and from a breathing interface; an exhalation port in the housing for exhaled air; an inhalation plate disposed between the filtration media and the respiration port; the exhalation check valve disposed proximate to the respiration pathway relative to the filtration media; an inhalation check valve set in the inhalation plate, the inhalation check valve having an open state during inhalation and a closed state during exhalation; an exhalation check valve set in the exhalation port, the exhalation check valve having a closed state during inhalation and an open state during exhalation; whereby inhaled air is passed through the filter cartridge inlet, is filtered by the filtration media, is then passed through the inhalation check valve in its open state, is blocked from the exhalation port by the exhalation valve in its closed state, and passed to the respiration port; whereby exhaled air is passed from the respiration port, is blocked by the inhalation valve in its closed state, through the exhalation check valve in its open state and then discharged out the exhalation port.

14. The filter cartridge of claim 13 further comprising a breathing interface fluidly coupled to the filter, the breathing interface selected from the group consisting of hoods, helmets, full face pieces, half-masks, quarter-masks, mouthpieces and protective suits with integrated hoods.

15. A filter cartridge enveloping both an inhalation check valve and an exhalation check valve, the inhalation check valve fluidly coupling a particulate filter housing to a respiration port and the exhalation check valve fluidly coupling the respiration port to the exhalation port, the exhalation check valve disposed proximate to the respiration pathway relative to the filtration media whereby the inhalation check valve permits inhalation of filtered air but blocks exhaled air from reaching a filtration media and the exhalation check valve permits exhalation to the exhalation port but does not permit inhaled air from reaching the exhalation port.

16. The filter cartridge of claim 15 wherein the exhalation port is formed by an exhalation valve cover over the exhalation check valve.

* * * * *